United States Patent [19]

Nakajima

[11] Patent Number: 4,811,397

[45] Date of Patent: Mar. 7, 1989

[54] APPARATUS FOR RECORDING AND REPRODUCING HUMAN SPEECH

[75] Inventor: Takao Nakajima, Yokohama, Japan

[73] Assignee: Kabushiki Kaisha Toshiba, Kawasaki, Japan

[21] Appl. No.: 780,931

[22] Filed: Sep. 27, 1985

[30] Foreign Application Priority Data

Sep. 28, 1984 [JP] Japan ..... 59-203254

[51] Int. Cl.[4] ..... G10L 5/00

[52] U.S. Cl. ..... 381/36; 364/513.5

[58] Field of Search ..... 381/36, 43, 51; 364/513.5

[56] References Cited

U.S. PATENT DOCUMENTS

| | | | |
|---|---|---|---|
| 4,163,120 | 7/1979 | Baumwolspiner | 364/513.5 |
| 4,429,367 | 1/1984 | Ikeda | 381/51 X |
| 4,675,840 | 6/1987 | Raymond et al. | 364/513.5 |
| 4,698,776 | 10/1987 | Shibata | 364/513.5 |

OTHER PUBLICATIONS

"Speech Synthesis LSIs", Toshiba Electron Device News, vol. 1, No. 2, pp. 18–21, 1984.

*Primary Examiner*—Peter S. Wong
*Assistant Examiner*—Marc S. Hoff
*Attorney, Agent, or Firm*—Foley & Lardner, Schwartz, Jeffery, Schwaab, Mack, Blumenthal & Evans

[57] ABSTRACT

An analysis and synthesis device for analyzing human speech. Each phrase is memorized and analyzed, for later synthesis based on the analyzed data. The memory has a data area for analyzing each phrase and an index area for storing control information applicable to each phrase. A control means writes the analyzed data in the data area and writes control information in the index area. When speech synthesis is effected, the control means reads the analyzed data out of the data area on the basis of the control information stored in the index area. Thus, the speech analysis and synthesis device lessens the load on the control device.

8 Claims, 3 Drawing Sheets

APPARATUS FOR RECORDING AND REPRODUCING HUMAN SPEECH

BACKGROUND OF THE INVENTION

The present invention relates to an apparatus for analyzing and synthesizing units of human speech, such as a word and a composition.

A speech analysis and synthesis device usually performs analysis and synthesis of human speech by dividing units into unit human speech called "phrase" hereinafter) such as a word, a clause, and a sentence.

Namely, the speech analysis and synthesis device analyzes human speech per phrase, stores the analyzed data into a memory and reads the analyzed data per unit from the memory to synthesize the human speech per phase. For effecting the control of speech analysis and synthesis in the prior art, control information, e.g. address or analysis and synthesis conditions, etc. of the analyzed data for unit speech on the memory, is stored in a memory connected to a microprocessor for governing speech analysis and synthesis. This results in a heavy load on the hardware or software of the microprocessor.

Another method is proposed to store control information in a ROM to lessen the load on a microprocessor. However, with this method, it is impossible to change addresses on the memory, or analysis and synthesis conditions. This results in the problem that the kinds of human speech that can be analyzed and synthesized are limited.

SUMMARY OF THE INVENTION

An object of the present invention is to provide a speech analysis and synthesis device making it possible to lessen the load on a control device for the speech analysis and synthesis device, and to change control information in accordance with human speech to be analyzed and synthesized.

To achieve this object, there is provided an apparatus for analyzing and synthesizing human speech comprising: means for analyzing the human speech per phrase to produce analyzed data and synthesizing the human speech per each phrase based on said analyzed data;

There is also provided a memory means means having a data area in which said analyzed data is stored per each phrase, and an index area in which control information per phrase of said analyzed data is stored; and control means wherein when speech analysis is effected, said control means is operative to write said analyzed data in said data area per phrase, and to write control information per phrase of said analyzed data in said index area, while when speech synthesis is effected, said control means is operative to read said analyzed data out of said data area based on the control information stored in said index area.

DETAILED DESCRIPTION OF THE INVENTION

Figure 1:
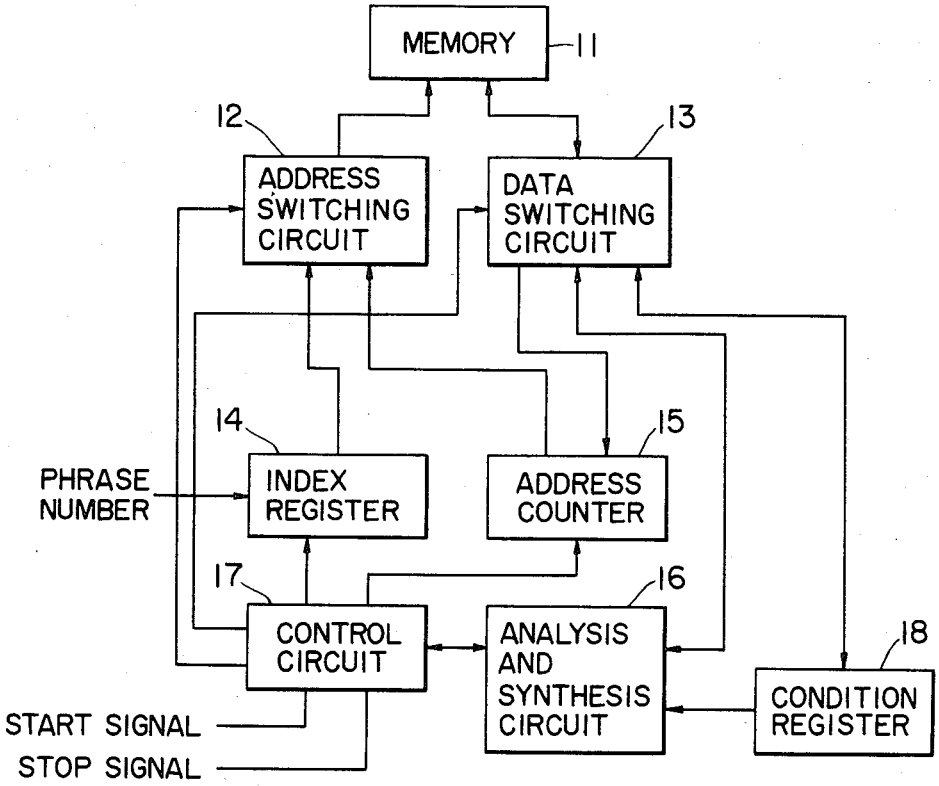
FIG. 1 is a block diagram illustrating a first embodiment of a speech analysis and synthesis device according to the present invention.
Figure 2:
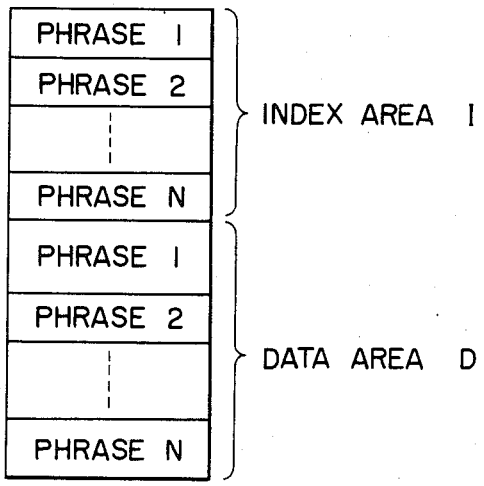
FIG. 2 shows a memory map for a memory employed in the speech analysis and synthesis device shown in FIG. 1.

Referring to FIG. 1, there is shown a first embodiment of a speech analysis and synthesis device according to the present invention. A memory 11 is capable of rewriting, such as a RAM or a magnetic disk unit. The memory 11 is connected to an index area I and a data area D, as shown in FIG. 2. Human speech is analyzed per each phrase by the analysis and synthesis circuit 16. Analysis and synthesis conditions are stored in a condition register 18, and the analyzed data are stored in the data area D. Control information for each phrase is stored in the index area I. The control information includes a head address of an area on the data area D allocated for the analyzed data and analyzed conditions stored in the condition register 18, etc. The analyzed conditions are a bit rate, or information indicative of silent or unvoiced sound, or voiced sound, etc. The memory size of each phrase in the data area D varies depending upon the phrase. The memory sizes of each phrase in the index area I are equal. Thus, an address assigned to an area where the control information of the each phrase is stored can be calculated from the corresponding phrase number. From the control information, the head address of the analyzed data of the phrase in the data area D can be provided.

The address counter 15 is operative to output an address indicative of location of a memory cell to which access to the memory 11 is provided. An index register 14 provides an address indicative of location in the index area I of the memory cell in which control information of the phrase to be analyzed and synthesized is stored. The address switching circuit 12 selects one of the index register 14 and the address counter 15 to output the content of the index register 14 or the address counter 15 as an address to the memory 11. A data switching circuit 13 selects one among the address counter 15, the analysis and synthesis circuit 16 and the condition register 18 to effect data exchange between the selected one and the memory 11. The above-mentioned speech analysis and synthesis device is controlled by a control circuit 17. A start signal and a stop signal are inputted to the control circuit 17.

The operation of the speech analysis and synthesis device will be described.

When a start signal is inputted to the control circuit 17, prior to speech analysis, an address of the index area I calculated from a desired phrase number is loaded into the index register 14. The address switching circuit 12 becomes operative to select the index register 14 and to output its contents as an address of the memory 11. At this time, the data switching circuit 13 becomes operative to select the address counter 15. Thus, the value of the address counter 15, i.e., the head address on the data area D where analyzed data is stored is memorized into an area assigned to the address provided by the index register 14. Then, the data switching circuit 13 becomes operative to select the condition register 18 to, subsequent to the head address, store the analysis and synthesis condition stored in the condition register 18 into the index area I. Subsequently, when speech analysis is initiated based on the analysis and synthesis conditions, the address switching circuit 12 becomes operative to select the address counter 15 to output the content of the address counter 15 as an address to the memory 11. On the other hand, the data switching circuit 13 becomes operative to select the analysis and synthesis circuit 16, allowing analyzed data outputted from the analysis and synthesis circuit 16 to be written into the data area D of the memory 11 through the data switching circuit 13. The content of the address counter 15 is sequentially updated until a stop signal is inputted to the control circuit 17 and speech analysis is completed.

The operation of speech synthesis will now be described. When a start signal is inputted to the control circuit 17, prior to synthesis of human speech, an address of the index area I calculated from a desired phrase number is loaded into the index register 14. The address switching circuit 12 becomes operative to select the index register 14 to output the content of the index register 14 as an address to the memory 11. At this time, the data switching circuit becomes operative to select the address counter 15. Thus, a head address of the desired phrase stored in the index area I of the memory is loaded into the address counter 15. Then, the data switching circuit 13 becomes operative to select the condition register 18 to store the analysis and synthesis condition stored in the index area I into the condition register 18.

Subsequently, when speech synthesis is initiated, the address switching circuit 12 becomes operative to select the address counter 15 to output the content of the address counter 15 as an address to the memory 11. The data switching circuit 13 becomes operative to select the analysis and synthesis circuit 16 to input analyzed data which is read out from the data area D of the memory 11 to the analysis and synthesis circuit 16 through the data switching circuit 12, thus performing speech synthesis. Speech synthesis can be stopped by inputting a stop signal to the control circuit 17 while speech synthesis is performed.

In the above-mentioned embodiment, the final address of the analyzed data is not memorized as control information. S analysis and synthesis may be performed by using the PARCOR or LSP methods for creating a code indicative of termination of phrase as analyzed data. Further, in FIG. 2, the index area I is provided in an area of an address smaller than that of the data area D. When needed, the index area I may be provided at the final portion of the memory of an address greater than that of the data area D.

As stated above, in accordance with the first embodiment, even when the length of phrase, or speech analysis and analyzed condition, etc. is changed, it is possible to easily change control information in the index area. Further, desired speech analysis and synthesis can be performed by simply inputting a phrase number from the external controller. As a result, there is no need that a device for controlling speech analysis and synthesis be aware of the head address of analyzed data or analysis and synthesis conditions, with the result that the load on the controller can be extremely reduced.

Figure 3:
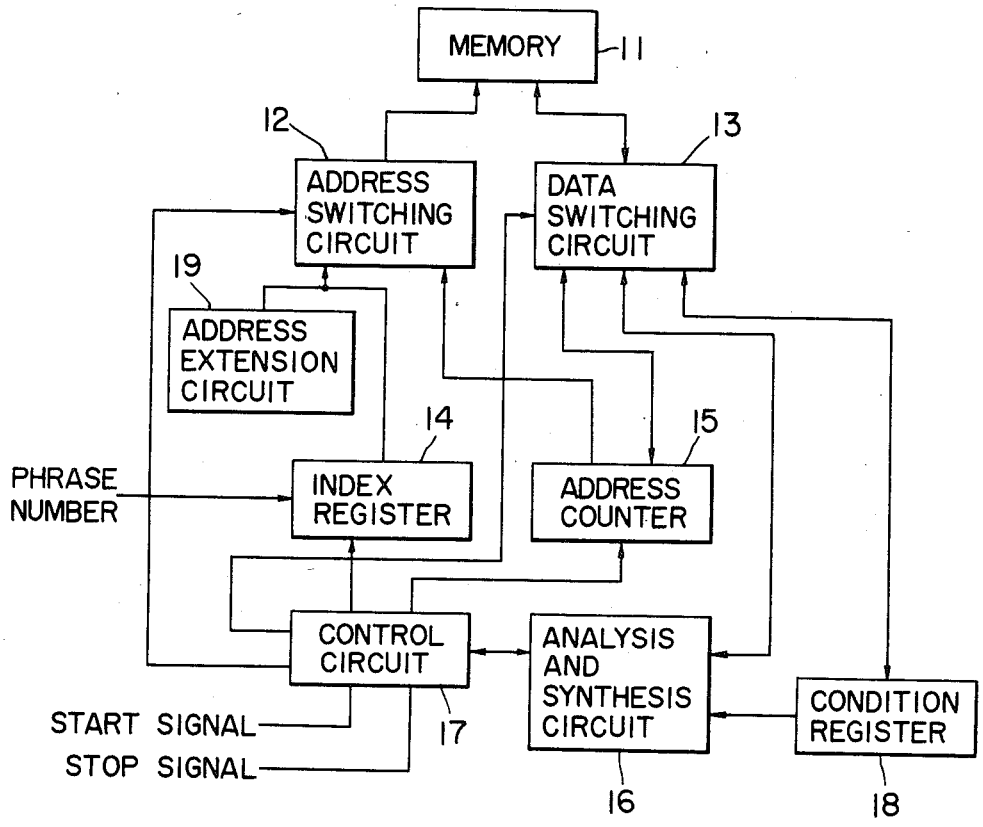
FIG. 3 is a block diagram illustrating a second embodiment of a speech analysis and synthesis device according to the present invention.

FIG. 3 shows a second embodiment of a speech analysis and synthesis device according to the present invention. The second embodiment is characterized in that there is provided an address extension circuit 19 operative to output an additive bit to add the additive bit to the address outputted from the index register 14 on the side of high-order bit. The index area I is smaller than the data area D and the high-order plural bits of an address assigned to the index area I are the same values. The address extension circuit 19 is operative to output the high-order plural bits as an additive bit. The additive bit from the address extension circuit 19 is added to the address from the index register 14 and a resultant address thus obtained is inputted to the address switching circuit 12.

Figure 4:
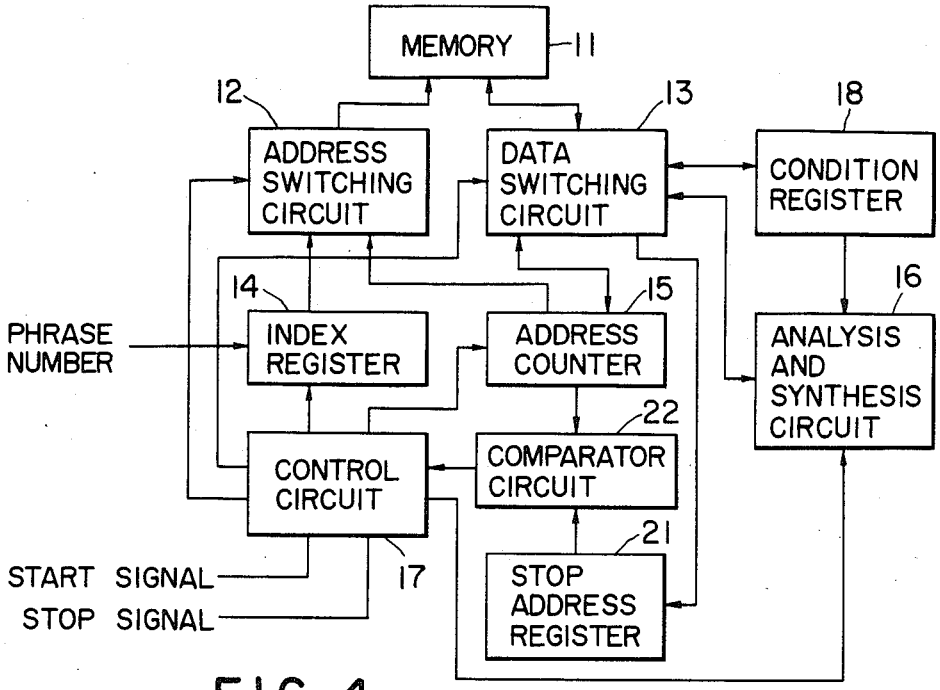
FIG. 4 is a block diagram illustrating a third embodiment of a speech analysis and synthesis device according to the present invention.

FIG. 4 shows a third embodiment of a speech analysis and synthesis device according to the present invention. The speech analysis and synthesis device in this embodiment is characterized in that a stop address register 21 and a comparator circuit 22 are further provided with the speech analysis and synthesis device in the first embodiment. While synthesizing, the stop address register 21 provides the final address of an area where analyzed data on the data area D. of the memory 11 is stored. The comparator circuit 22 is operative to compare the content of the stop address register 21 with that of the address counter 15 to output a coincidence signal to the control circuit 17 when coincident relationship is established. In this embodiment, the final address of analyzed data of each phrase is also stored in the index area I.

The operation of the speech analysis and synthesis device according to the third embodiment will be described.

When a start signal is inputted to the control circuit 17, prior to speech analysis, an address of the index area I calculated from a desired phrase number is loaded into the index register 14. The address switching circuit 12 becomes operative to select the index register 14 to output the content of the index register 14 as an address of the memory 11. At this time, the data switching circuit 13 becomes operative to select the address counter 15. Thus, the value of the address counter 15, i.e., the head address on the data area D where the analyzed data is stored is memorized into an area assigned to the address provided by the index register 14. Then, the data switching circuit 13 becomes operative to select the condition register 18 to, subsequent to the head address, store the analysis and synthesis condition stored in the condition register 18 into the index area I. Subsequently, when speech analysis is initiated based on the analysis and synthesis conditions, the address switching circuit 12 becomes operative to select the address counter 15 to output the content of the address counter 15 as an address to the memory 11. On the other hand, the data switching circuit 13 becomes operative to select the analysis and synthesis circuit 16, allowing analyzed data outputted from the analysis and synthesis circuit 16 to be written into the data area D of the memory 11 through the data switching circuit 13. The content of the address counter 15 is sequentially updated until a stop signal is inputted to the control circuit 17 and speech analysis is completed. When analysis is completed, the address switching circuit 12 selects the index register for a second time and the data switching circuit 13 selects the address counter 15. Thus, the content of the address counter 15 at this time, i.e., the final address of the area in the memory 11 where the analyzed data is stored is written into the index area I of the memory 11 through the data switching circuit 13.

The operation of speech synthesis will now be described. When a start signal is inputted to the control circuit 17, prior to synthesis of human speech, an address of the index area I calculated from a desired phrase number is loaded into the index register 14. The address switching circuit 12 becomes operative to select the index register 14 to output the content of the index register 14 as an address to the memory 11. At this time, the data switching circuit 13 becomes operative to select the address counter 15 and the stop address register 21. Thus, the head address of a desired phrase and the final address stored in the index area I of the memory 11 are loaded into the address counter 15 and the stop address register 21, respectively. Then, the data switching circuit 13 becomes operative to select the condition register 18 to store the analysis and synthesis condition stored in the index area I into the analysis and synthesis condition register 18.

Subsequently, when speech synthesis is initiated, the address switching circuit 12 becomes operative to select the address counter 15 to output the content of the address counter 15 as an address to the memory 11. The data switching circuit 13 becomes operative to select the analysis and synthesis circuit 16 to input analyzed data which is read out from the data area D of the memory 11 to the analysis and synthesis circuit 16 through the data switching circuit 13, thus performing speech synthesis. During speech synthesis operation, the content of the address counter 15 is sequentially updated. When the comparator circuit 22 detects that the content of the address counter 15 is coincident with that of the stop address register 21, synthesis operation is stopped. Speech synthesis can be stopped by inputting a stop signal to the control circuit 17 while speech synthesis is performed.

The speech analysis and synthesis device in this embodiment is configured so that the head address and the final address of the analyzed data are memorized, resulting in an excellent adaptability to an analysis and synthesis device using a wave form coding method, such as ADM and ADPCM by which termination of the analyzed data cannot be known from the analyzed data itself.

Figure 5:
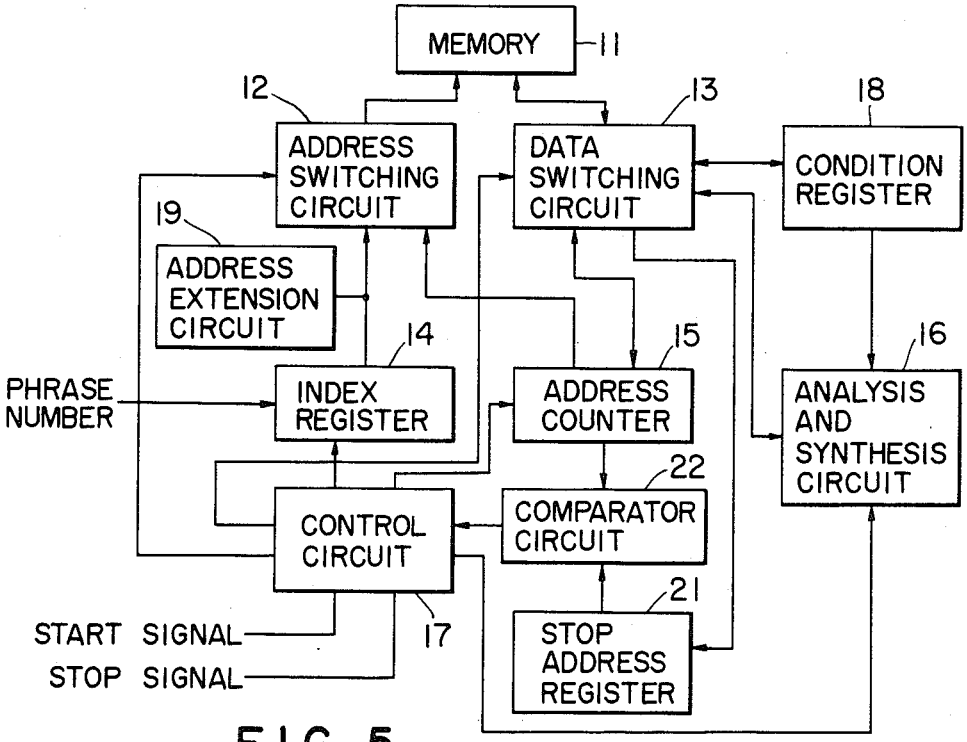
FIG. 5 is a block diagram illustrating a fourth embodiment of a speech analysis and synthesis device according to the present invention.

FIG. 5 shows a fourth embodiment of a speech analysis and synthesis device according to the present invention. The apparatus in this embodiment is characterized in that there is provided an address extension circuit 19 operative to output an additive bit to add the additive bit to the address outputted from the index register 14. The additive bit outputted from the address extension circuit 19 is added to the address outputted from the index register 14 and is inputted to the address switching circuit 12.

In this embodiment, the head address and the final address of the analytical data are stored in the index area I. Instead, the head address and the number of bits of the analyzed data may be memorized.

As stated above, the speech analysis and synthesis device according to the present invention makes it possible to lessen a load on a device for controlling the speech analysis and synthesis device, and to change control information in accordance with human speech to be analyzed and synthesized. Where it is required to operate a speech analysis and synthesis device alone without using a control device such as a microprocessor, some control signals are provided in addition to desired phrase numbers, thereby making it possible to realize a relatively high level speech analysis and synthesis device in a simplified manner, which provides good adaptability to speech analysis and synthesis LSI implementation.

What is claimed is:

1. An apparatus for analyzing phrases of human speech to produce and record analyzed data and for synthesizing such phrases based on said analyzed data, comprising:

an analysis and synthesis condition register for storing analysis and synthesis conditions;

memory means capable of rewriting data, said memory means having a data area in which said analyzed data is stored per phase, and an index area in which control information is stored per phase of said analyzed data, said control information including a head address in said data area in which said analyzed data is stored;

an address counter producing an address indicative of a location of a memory cell within said data area to which said analyzed data is accessed;

an index register producing an address indicative of a location of a memory cell within said index area to which said control information is accessed; and control means operative, when speech analysis is effected, operative to write an address received from said address counter as said head address and set said analysis and synthesis conditions in the memory cell within said index area addressed by the address received from said index register, said control means writing said analyzed data in the memory cell addressed by the address applied by said address counter, said control means operative when speech synthesis is effected to read said head address and said analysis and synthesis conditions stored in said index area, set said head address to said address counter and set said analysis and synthesis conditions to said analysis and synthesis conditions register, and read said analyzed data from the memory cell addressed by the address applied from said address counter.

2. An apparatus according to claim 1, further comprising address extension means for producing at least one additive bit to add to the address outputted from said index register, the number of bits of the address applied from said index register being the same as the number of bits of the address applied from said address counter.

3. An apparatus according to claim 1, wherein said memory means is a random access memory.

4. An apparatus according to claim 2, wherein said memory means is a random access memory.

5. An apparatus according to claim 1, further comprising a final address register for storing the final address in an area within said data area where said analyzed data is stored, wherein said control information includes said final address, and, when speech synthesis is effected, said control means operative to read said analyzed data until the address applied from said address counter reaches said final address.

6. An apparatus according to claim 5, further comprising address extension means for producing at least one additive bit to add the address outputted from said index register, the sum of the additive bit and the number of bits of the address applied from said index register being the same as the number of bits of the address applied from said address counter.

7. An apparatus according to claim 5, wherein said memory means is a random access memory.

8. An apparatus according to claim 6, wherein said memory means is a random access memory.

* * * * *